US010072316B2

(12) United States Patent
Kawabe et al.

(10) Patent No.: US 10,072,316 B2
(45) Date of Patent: Sep. 11, 2018

(54) HIGH-STRENGTH COLD-ROLLED STEEL SHEET AND METHOD FOR PRODUCING THE SAME

(71) Applicant: JFE STEEL CORPORATION, Tokyo (JP)

(72) Inventors: Hidetaka Kawabe, Chiba (JP); Takeshi Yokota, Chiba (JP); Reiko Sugihara, Chiba (JP); Daigo Itoh, Chiba (JP); Kazunori Tahara, Chiba (JP)

(73) Assignee: JFE STEEL CORPORATION, Tokyo (JP)

( * ) Notice: Subject to any disclaimer, the term of this patent is extended or adjusted under 35 U.S.C. 154(b) by 200 days.

(21) Appl. No.: 14/436,685

(22) PCT Filed: Oct. 16, 2013

(86) PCT No.: PCT/JP2013/006139
§ 371 (c)(1),
(2) Date: Apr. 17, 2015

(87) PCT Pub. No.: WO2014/061270
PCT Pub. Date: Apr. 24, 2014

(65) Prior Publication Data

US 2016/0168656 A1 Jun. 16, 2016

(30) Foreign Application Priority Data

Oct. 18, 2012 (JP) ..... 2012-230484

(51) Int. Cl.

| | |
|---|---|
| ***C21D 9/46*** | (2006.01) |
| ***C21D 8/02*** | (2006.01) |
| ***C22C 38/14*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C21D 6/00*** | (2006.01) |

(52) U.S. Cl.
CPC ..... *C21D 9/46* (2013.01); *C21D 6/005* (2013.01); *C21D 6/008* (2013.01); *C21D 8/02* (2013.01); *C21D 8/0205* (2013.01); *C21D 8/0226* (2013.01); *C21D 8/0236* (2013.01); *C21D 8/0247* (2013.01); *C21D 8/0263* (2013.01); *C22C 38/001* (2013.01); *C22C 38/002* (2013.01); *C22C 38/02* (2013.01); *C22C 38/04* (2013.01); *C22C 38/06* (2013.01); *C22C 38/14* (2013.01); *C21D 2211/001* (2013.01); *C21D 2211/002* (2013.01); *C21D 2211/005* (2013.01); *C21D 2211/008* (2013.01)

(58) Field of Classification Search
CPC ..... C21D 2211/001; C21D 2211/002; C21D 2211/005; C21D 2211/008; C21D 6/005; C21D 6/008; C21D 8/02; C21D 8/0205; C21D 8/0226; C21D 8/0236; C21D 8/0247; C21D 8/0263; C21D 9/46; C22C 38/001
See application file for complete search history.

(56) References Cited

U.S. PATENT DOCUMENTS

| | | | | |
|---|---|---|---|---|
| 2008/0000555 | A1 | 1/2008 | Nonaka et al. | |
| 2009/0314395 | A1 | 12/2009 | Nonaka et al. | |
| 2011/0139315 | A1 | 6/2011 | Nakagaito et al. | |
| 2013/0167980 | A1* | 7/2013 | Kawata | C21D 8/0226 148/504 |
| 2014/0212684 | A1* | 7/2014 | Kawata | C23C 2/28 428/632 |
| 2014/0212686 | A1* | 7/2014 | Imai | C21D 8/0236 428/659 |
| 2014/0227555 | A1* | 8/2014 | Kawata | B21B 1/26 428/659 |

FOREIGN PATENT DOCUMENTS

| | | | |
|---|---|---|---|
| CN | 101035921 | A | 9/2007 |
| CN | 101932744 | A | 12/2010 |
| EP | 1808505 | A1 | 7/2007 |
| EP | 2 053 140 | A1 | 4/2009 |
| EP | 2 243 852 | A1 | 10/2010 |
| EP | 2 258 886 | A1 | 12/2010 |

(Continued)

OTHER PUBLICATIONS

Carbon and Low-Alloy Steel Sheet and Strip, Properties and Selection: Irons, Steels, and High-Performance Alloys, vol. 1, ASM Handbook, ASM International, 1990, p. 200-211.*
Mar. 3, 2016 Office Action issued in Chinese Application No. 201380054501.1.
Jan. 21, 2014 International Search Report issued in PCT/JP2013/006139.
Jan. 14, 2016 Office Action issued in Korean Application No. 2015-7008751.
Mar. 22, 2017 Office Action issued in European Patent Application No. 13847783.1.

(Continued)

*Primary Examiner* — Colleen P Dunn
*Assistant Examiner* — Nicholas A Wang
(74) *Attorney, Agent, or Firm* — Oliff PLC

(57) ABSTRACT

A cold-rolled steel sheet having a steel composition comprising, by mass %, 0.12% to 0.22% C, 0.8% to 1.8% Si, 1.8% to 2.8% Mn, 0.020% or less P, 0.0040% or less S, 0.005% to 0.08% Al, 0.008% or less N, 0.001% to 0.040% Ti, 0.0001% to 0.0020% B, 0.0001% to 0.0020% Ca, and Fe and incidental impurities. The steel sheet includes a microstructure in which ferrite and bainite phases are 50% to 70% of the total area, the average grain size of the ferrite and bainite phase is 1 to 3 μm, a tempered martensite phase is 25% to 45% of the total area, the average grain size of the tempered martensite phase is 1 to 3 μm, and a retained austenite phase is 2% to 10% of the total area.

14 Claims, No Drawings

(56) References Cited

FOREIGN PATENT DOCUMENTS

| | | | | |
|---|---|---|---|---|
| JP | 2001-207235 | A | | 7/2001 |
| JP | 2001207235 | | * | 7/2001 |
| JP | 2004-308002 | A | | 11/2004 |
| JP | 2004-359974 | A | | 12/2004 |
| JP | 2005-179703 | A | | 7/2005 |
| JP | 2006-104532 | A | | 4/2006 |
| JP | 2006-283130 | A | | 10/2006 |
| JP | 2007177272 | A | | 7/2007 |
| JP | 2009-203548 | A | | 9/2009 |
| JP | 2010-196115 | A | | 9/2010 |
| JP | 2012-122093 | A | | 6/2012 |
| JP | 2012122093 | | * | 6/2012 |
| WO | WO2012036269 | | * | 3/2012 |
| WO | WO2013005670 | | * | 1/2013 |
| WO | WO2013018739 | | * | 2/2013 |
| WO | WO2013047755 | | * | 4/2013 |

OTHER PUBLICATIONS

May 13, 2014 Office Action issued in Japanese Patent Application No. 2012-230484.

Oct. 8, 2015 Search Report issued in European Patent Application No. 13847783.1.

* cited by examiner

HIGH-STRENGTH COLD-ROLLED STEEL SHEET AND METHOD FOR PRODUCING THE SAME

TECHNICAL FIELD

The present application relates to a high-strength cold-rolled steel sheet suitably used for press-formed components having complex shapes, such as structural components for automobiles, and a method for producing the high-strength cold-rolled steel sheet. In particular, the present application relates to a high-strength cold-rolled steel sheet having excellent elongation, stretch-flangeability, and bendability and having a tensile strength (TS) of 1180 MPa or more and a method for producing the high-strength cold-rolled steel sheet.

BACKGROUND ART

Hitherto, cold-rolled steel sheets each having a tensile strength (TS) of 1180 MPa or more have often been used for automotive components lightly worked by, for example, roll forming. Nowadays, cold-rolled steel sheets each having a tensile strength (TS) of 1180 MPa or more for press-formed components with complex shapes, such as structural members for automobiles, are increasingly being used in order to achieve both higher collision safety of automobiles and improvement in fuel efficiency owing to a reduction in the weight of automotive bodies. Thus, there is a high demand for cold-rolled steel sheet having a tensile strength (TS) of 1180 MPa or more and having excellent workability, in particular, elongation, stretch flangeability, and bendability.

In general, an increase in the strength of steel sheets has a tendency to lead to a reduction in workability. To broaden the use of high-strength steel sheets, it is thus necessary to avoid the breakage of strengthened steel sheets at the time of press forming. In the case where a steel sheet is strengthened so as to have a tensile strength (TS) of 1180 MPa or more, a very expensive scarce element, for example, Nb, V, Cu, Ni, Cr, or Mo, is actively added in addition to C and Mn from the viewpoint of ensuring strength, in some cases.

As the related art regarding high-strength cold-rolled steel sheets having excellent workability, there are Patent Literatures 1 to 4. Patent Literatures 1 to 4 each disclose a technique for producing a high-strength cold-rolled steel sheet including a tempered martensite phase and/or a retained austenite phase in a steel microstructure by the limitation of a steel chemical composition and microstructure or by the optimization of hot-rolling conditions or annealing conditions.

CITATION LIST

Patent Literature

PTL 1: Japanese Unexamined Patent Application Publication No. 2004-308002

PTL 2: Japanese Unexamined Patent Application Publication No. 2005-179703

PTL 3: Japanese Unexamined Patent Application Publication No. 2006-283130

PTL 4: Japanese Unexamined Patent Application Publication No. 2004-359974

SUMMARY

Technical Problem

In a technique described in Patent Literature 1, any expensive element is not essentially used as an alloying element. However, blocky martensite having an aspect ratio of 3 or less is present in a steel microstructure in a proportion of 15% to 45%. The blocky martensite is a hard martensite phase. The presence of such the martensite can adversely affect stretch flangeability and bendability.

In a technique described in Patent Literature 2, the finding that high elongation (El) is achieved using a retained austenite phase at a tensile strength (TS) of about 780 to about 980 MPa is disclosed. However, referring to examples of Patent Literature 2, a desired retained austenite phase is obtained when expensive Cu and Ni, which serve as elements that stabilize austenite, is added. Moreover, in a steel sheet having a high carbon content and having a tensile strength (TS) of 1180 MPa or more, sufficient stretch flangeability is not achieved. In addition, there are no findings regarding bendability.

In a technique described in Patent Literature 3, the volume fraction of a tempered martensite phase is as high as 50% or more, and a sufficient balance between tensile strength (TS) and elongation (El) (TS×El balance) is not achieved. In addition, there are no findings regarding improvements in stretch flangeability and bendability.

In a technique described in Patent Literature 4, the addition of expensive Mo and V is essential. In Patent Literature 4, there are no findings regarding workability. In the technique described in Patent Literature 4, the volume fraction of a retained austenite phase is low, and the volume fraction of tempered martensite phase is high. Thus, there are concerns about workability.

It is an object of this disclosure to advantageously solve the foregoing problems in the related art and to provide a high-strength cold-rolled steel sheet having excellent workability, such as excellent elongation, stretch flangeability, and bendability, and a tensile strength (TS) of 1180 MPa or more and a method for producing the high-strength cold-rolled steel sheet. That is, it is an object of the present disclosure to provide a high-strength cold-rolled steel sheet having excellent workability described above by adjusting a metal microstructure using a chemical composition to which expensive alloying element, for example, Nb, V, Cu, Ni, Cr, or Mo, is not actively added.

Solution to Problem

To solve the foregoing problems, the present inventors have conducted intensive studies and have found that a high-strength cold-rolled steel sheet having excellent workability and a tensile strength (TS) of 1180 MPa or more is produced by means of items i) and ii) described below without the addition of an expensive alloying element as described above.

i) Controlling the area proportions of a ferrite phase and a bainite phase, a tempered martensite phase, and a retained austenite phase in a metal microstructure.

ii) Strictly controlling the crystal grain sizes of the ferrite phase and the bainite phase and the crystal grain size of the tempered martensite phase that has been softened by annealing (tempering treatment).

Disclosed embodiments are based on the foregoing findings, as described below.

[1] A high-strength cold-rolled steel sheet includes a chemical composition containing, on a mass percent basis:

0.12% to 0.22% C;
0.8% to 1.8% Si;
1.8% to 2.8% Mn;
0.020% or less P;
0.0040% or less S;

0.005% to 0.08% Al;

0.008% or less N;

0.001% to 0.040% Ti;

0.0001% to 0.0020% 13;

0.0001% to 0.0020% Ca; and the balance being Fe and incidental impurities, in which the high-strength cold-rolled steel sheet has a microstructure in which the total area proportion of a ferrite phase and a bainite phase is 50% to 70%, the average grain size of the ferrite phase and the bainite phase is 1 to 3 μm, the area proportion of a tempered martensite phase is 25% to 45%, the average grain size of the tempered martensite phase is 1 to 3 μm, and the area proportion of a retained austenite phase is 2% to 10%.

[2] In the high-strength cold-rolled steel sheet described in item [1], (the average grain size of the ferrite phase and the bainite phase)/(the average grain size of the tempered martensite phase) is 0.5 to 3.0.

[3] A method for producing a high-strength cold-rolled steel sheet includes preparing a steel slab having the chemical composition described in item [1]; hot-rolling the steel slab into a steel sheet; performing pickling; subjecting the steel sheet after the pickling to a first heat treatment at a heat treatment temperature of 350° C. to 550° C.; then performing cold rolling; subjecting the steel sheet after the cold rolling to a second heat treatment at a heat treatment temperature of 800° C. to 900° C., a cooling rate of 10 to 80° C./s, a cooling stop temperature of 300° C. to 500° C., and a holding time of 100 to 1000 seconds at 300° C. to 500° C.; and then performing a third heat treatment at a heat treatment temperature of 150° C. to 250° C.

[4] In the method for producing a high-strength cold-rolled steel sheet described in item [3], as conditions for the hot rolling, the heating temperature of the steel slab is 1100° C. to 1300° C., and the finishing temperature of the hot rolling is 850° C. to 950° C.

[5] In the method for producing a high-strength cold-rolled steel sheet described in item [3] or [4], the first heat treatment is performed for a holding time of 5 minutes to 5 hours at 350° C. to 550° C.

[6] In the method for producing a high-strength cold-rolled steel sheet described in any one of items [3] to [5], the third heat treatment is performed for a holding time of 5 minutes to 5 hours at 150° C. to 250° C.

Advantageous Effects

According to embodiments, a high-strength cold-rolled steel sheet having excellent elongation, stretch flangeability, and bendability and having a tensile strength (TS) of 1180 MPa or more can be provided without actively adding an expensive element. The high-strength cold-rolled steel sheet according to embodiments is suitable for an automotive component with a shape that is not easily ensured by press forming.

DETAILED DESCRIPTION

The inventors have conducted intensive studies on improvement in the workability of a high-strength cold-rolled steel sheet and have found that even in the case where a steel sheet has a chemical composition that does not contain any expensive element, for example, Nb, V, Cu, Ni, Cr, or Mo, the workability is significantly improved by allowing the high-strength cold-rolled steel sheet to have a metal microstructure described below while desired strength is ensured. That is, in the metal microstructure of a steel sheet according to embodiments, the total area proportion of a ferrite phase and a bainite phase is 50% to 70%, the average grain size of the ferrite phase and the bainite phase is 1 to 3 μm, the area proportion of a tempered martensite phase is 25% to 45%, the average grain size of the tempered martensite phase is 1 to 3 μm, and the area proportion of a retained austenite phase is 2% to 10%.

The limited range of the microstructures and chemical composition of steel to achieve a high-strength cold-rolled steel sheet having excellent elongation, stretch flangeability and bendability, and having a tensile strength (TS) of 1180 MPa or more, and reason for the limitation will be described in detail below. The units of element contents in a steel sheet are "percent by mass" and are simply indicated by "%" unless otherwise specified.

In embodiments, the limited ranges of the chemical components (composition) of steel and the reason for the limitation are described below.

C: 0.12% to 0.22%

C is an element that contributes to strength. C contributes to enhance strength by solid-solution hardening and transformation strengthening due to a martensite phase. A C content less than 0.12% causes difficulty in obtaining a tempered martensite phase having an area proportion required. Thus, the C content is 0.12% or more. Preferably, the C content is 0.15% or more. A C content more than 0.22% results in a significant reduction in spot weldability. Moreover, a C content more than 0.22% causes the tempered martensite phase to be excessively hardened. This reduces the formability of the steel sheet. In particular, the stretch flangeability is reduced. Thus, the C content is 0.22% or less. Preferably, the C content is 0.21% or less. Consequently, the C content is in the range of 0.12% to 0.22%.

Si: 0.8% to 1.8%

Si is an important element that promotes an increase in C content in austenite and stabilizes retained austenite. To provide the effects, the Si content needs to be 0.8% or more and preferably 1.0% or more. If Si is added in such a manner that the Si content is more than 1.8%, the steel sheet becomes brittle, causing cracking and reducing the formability. Thus, the upper limit of the Si content needs to be 1.8% and preferably 1.6%. Consequently, the Si content is in the range of 0.8% to 1.8%.

Mn: 1.8% to 2.8%

Mn is an element that improves hardenability and facilitates the formation of a tempered martensite phase that contributes to strength. To provide the effects, the Mn content needs to be 1.8% or more. The Mn content is preferably 2.0% or more. If Mn is added in such a manner that the Mn content is more than 2.8%, the steel sheet can be excessively hardened to cause slab racking because of the lack of ductility at high temperatures. Thus, the Mn content is 2.8% or less. Preferably, the Mn content is less than 2.6%. Consequently, the Mn content is in the range of 1.8% to 2.8% and preferably 2.0% or more and less than 2.6%.

P: 0.020% or less

P adversely affects spot weldability. Thus, the P content is preferably minimized. However, a P content of up to 0.020% is acceptable. Thus, the P content is 0.020% or less. Preferably, the P content is 0.010% or less. An excessive reduction in P content reduces the production efficiency of a steelmaking process, increasing the production cost. Thus, the lower limit of the P content is preferably about 0.001%.

S: 0.0040% or less

S segregates to grain boundaries and is likely to cause hotshort embrittlement. Moreover, S forms a sulfide inclusion, such as MnS. The sulfide inclusion elongates when cold rolling is conducted and acts as a crack initiation point when a steel sheet is deformed, thereby reducing the local deformability of the steel sheet. Thus, the S content is preferably minimized. However, a S content of up to 0.0040% is acceptable. Hence, the S content is 0.0040% or less. Preferably, the S content is 0.0020% or less. An excessive reduction in S content is industrially difficult and involves an increase in desulfurization cost in a steelmaking process. Consequently, the lower limit of the S content is preferably about 0.0001%.

Al: 0.005% to 0.08%

Al is mainly added for deoxidation. Furthermore, Al is an element that inhibits the formation of a carbide and that is effective in forming a retained austenite phase and improving the balance between (or compatibility of) strength and elongation. To provide the effects, the Al content needs to be 0.005% or more. Preferably, the Al content is 0.02% or more. If Al is added in such a manner that the Al content is more than 0.08%, inclusions, such as alumina, are disadvantageously increased to reduce the workability of the steel sheet. Thus, the Al content is 0.08% or less. Preferably, the Al content is 0.06% or less. Consequently, the Al content is in the range of 0.005% to 0.08%. Preferably, the Al content is in the range of 0.02% or more and 0.06% or less.

N: 0.008% or less

N is an element that degrades the aging resistance. A N content more than 0.008% causes significant degradation in aging resistance. Further, N combines with B to form BN, so that N consumes B. As a result, N reduces hardenability resulting from dissolved B, and the reduced hardenability causes difficulty in ensuring a predetermined area proportion of the tempered martensite phase. Moreover, N is present as an impurity element in ferrite and reduces the ductility by strain aging. Thus, the N content is preferably minimized. However, a N content of up to 0.008% is acceptable. Thus, the N content is 0.008% or less. Preferably, the N content is 0.006% or less. An excessive reduction in N content leads to an increase in denitrification cost in steelmaking process. Hence, the lower limit of the N content is preferably about 0.0001%.

Ti: 0.001% to 0.040%

Ti forms a carbonitride (including carbide and nitride) or a sulfide and is effective in improving strength. Moreover, Ti inhibits the formation of BN by allowing N to precipitate in the form of TiN. Thus, Ti is effective in providing hardenability resulting from B. To provide the effects, the Ti content needs to be 0.001% or more. Preferably, the Ti content is 0.010% or more. A Ti content more than 0.040% results in an excessive formation of precipitates in a ferrite phase to cause excessive precipitation hardening, thereby reducing the elongation of the steel sheet. Thus, the Ti content needs to be 0.040% or less. Preferably, the Ti content is 0.030% or less. Consequently, the Ti content is in the range of 0.001% to 0.040%. Preferably, the Ti content is in the range of 0.010% to 0.030%.

B: 0.0001% to 0.0020%

B which enhance hardenability and contribute to ensure the tempered martensite phase and the retained austenite phase, is needed to achieve a good balance between strength and elongation. To provide the effects, the B content needs to be 0.0001% or more. Preferably, the B content is 0.0002% or more. At a B content more than 0.0020%, the effects are saturated. Thus, the B content needs to be 0.0020% or less. Preferably, the B content is 0.0010% or less. Consequently, the B content is in the range of 0.0001% to 0.0020%.

Ca: 0.0001% to 0.0020%

Ca has the effect of inhibiting a reduction in local deformability by transforming the shape of a sulfide from a plate-like shape to a spherical shape, the sulfide acting as a crack initiation point at the time of deformation. To provide the effect, the Ca content needs to be 0.0001% or more. Preferably, the Ca content is 0.0002% or more. If a large amount of Ca is contained in an amount more than 0.0020%, Ca is present in a surface layer of the steel sheet in the form of an inclusion. The inclusion acts as a initiation point of a microcrack at the time of the bending forming of the steel sheet and degrades the bendability of the steel sheet. Thus, the Ca content is 0.0020% or less. Preferably, the Ca content is 0.0010% or less. Consequently, the Ca content is in the range of 0.0001% to 0.0020%.

In the steel sheet according to embodiments, components other than the foregoing components are Fe and incidental impurities. However, a component other than the components described above may be contained to the extent that the effects of disclosed embodiments are not impaired.

If Nb and V are actively added, they precipitate in steel to cause difficulty in ensuring good elongation (El), thereby adversely affecting the material properties of the steel sheet. If Cu, Ni, Cr, and Mo are actively added, a martensite phase is excessively formed to cause difficulty in ensuring good elongation (El), thereby adversely affecting the material properties of the steel sheet. Thus, it is not preferred that these elements be contained. If these elements are contained, the levels of these elements are preferably equal to or lower than those of the incidental impurities.

The disclosed ranges of a steel microstructure according to embodiments and a reason for the ranges will be described in detail below.

Total Area Proportion of Ferrite Phase and Bainite Phase: 50% to 70%

The ferrite phase is softer than the hard martensite phase formed by the transformation of the austenite phase and contributes to ductility. The bainite phase is formed by the transformation of the austenite phase in a higher temperature range than the martensite phase. The bainite phase includes the ferrite phase and a cementite phase. As with the ferrite phase, the bainite phase is softer than the hard martensite phase and contributes to ductility.

To provide a desired elongation, thus, the area proportions of the ferrite phase and the bainite phase need to be 50% or more in total. In other words, the total area proportion of the ferrite phase and the bainite phase needs to be 50% or more and preferably 53% or more. If the total area proportion of the ferrite phase and the bainite phase is less than 50%, the area proportion of the hard martensite phase is increased. This results in an excessively strengthened steel sheet, thus reducing the elongation and stretch flangeability of the steel sheet.

If the total area proportion of the ferrite phase and the bainite phase is more than 70%, it is difficult to ensure a tensile strength (TS) of 1180 MPa or more. It is also difficult to ensure a predetermined amount of the retained austenite phase, which contributes to ductility. Thus, the total area proportion of the ferrite phase and the bainite phase is 70% or less and preferably 68% or less. Consequently, the total area proportion of the ferrite phase and the bainite phase is in the range of 50% to 70%.

Average Grain Size of Ferrite Phase and Bainite Phase (Together): 1 to 3 μm

If the ferrite phase and the bainite phase have a large average grain size more than 3 μm, it is difficult to uniformly deform the steel sheet at the time of stretch flanging and bending deformation. In other words, the stretch flangeability and bendability of the steel sheet are reduced. Thus, the ferrite phase and the bainite phase are required to have an average grain size of 3 μm or less and preferably 2.5 μm or less. If the ferrite phase and the bainite phase have a small average grain size less than 1 μm, grain boundaries constitute a large volume. Such a large amount of grain boundaries prevents the dislocation movement. This results in an excessively strengthened steel sheet, thereby causing difficulty in ensuring good elongation. Thus, the ferrite phase and the bainite phase are required to have an average grain size of 1 μm or more and preferably 1.4 μm or more. Consequently, the ferrite phase and the bainite phase have an average grain size of 1 to 3 μm.

Area Proportion of Tempered Martensite Phase: 25% to 45%

The tempered martensite phase is formed by reheating the hard martensite phase to an elevated temperature. The tempered martensite phase contributes to strength. To ensure the tensile strength (TS) of 1180 MPa or more, the tempered martensite phase is required to have an area proportion of 25% or more and preferably 28% or more. If the area proportion of the tempered martensite phase is excessively high, the elongation of the steel sheet is reduced. Thus, the tempered martensite phase is required to have an area proportion of 45% or less and preferably 44% or less. When the microstructure contains the tempered martensite phase in an area proportion of 25% or more and 45% or less, a steel sheet having a good balance of material characteristics, such as strength, elongation, stretch flangeability, and bendability is provided.

Average Grain Size of Tempered Martensite Phase: 1 to 3 μm

If the tempered martensite phase has a large average grain size more than 3 μm, it is difficult to uniformly deform the steel sheet at the time of stretch flanging and bending deformation. In other words, the stretch flangeability and bendability of the steel sheet are reduced. If the tempered martensite phase has a small average grain size less than 1 μm, grain boundaries constitute a large volume. Such a large amount of grain boundaries prevents the dislocation movement. This results in an excessively strengthened steel sheet, thereby causing difficulty in ensuring good ductility. Thus, the tempered martensite phase has an average grain size of 1 to 3 μm.

The average grain size of the ferrite phase and the bainite phase and the average grain size of the tempered martensite phase are controlled to the respective average grain sizes described above. Equalization of the average grain size of the ferrite phase and the bainite phase with the average grain size of the tempered martensite phase, in addition to the control, is preferred because more uniform deformation can be achieved at the time of working. In other words, a uniform, fine microstructure of the steel sheet as a whole is preferred because more uniform deformation can be achieved at the time of working.

Here, in the case where (the average grain size of the ferrite phase and the bainite phase)/(the average grain size of the tempered martensite phase) is less than 0.5 or is more than 3.0, one of the average grain size of the ferrite phase and the bainite phase and the average grain size of the tempered martensite phase is small or large. In comparison to the case, when (the average grain size of the ferrite phase and the bainite phase)/(the average grain size of the tempered martensite phase) is 0.5 to 3.0, it is possible to achieve more uniform deformation of the steel sheet at the time of stretch flanging and bending deformation. Thus, (the average grain size of the ferrite phase and the bainite phase)/(the average grain size of the tempered martensite phase) is preferably 0.5 to 3.0. More preferably, (the average grain size of the ferrite phase and the bainite phase)/(the average grain size of the tempered martensite phase) is 0.8 to 2.0.

Area Proportion of Retained Austenite Phase: 2% to 10%

The retained austenite phase has the effect of improving elongation by the hardening of a deformed portion of the steel sheet due to strain-induced transformation to prevent strain concentration. To achieve high elongation, it is necessary to allow the steel sheet to contain the retained austenite phase in an amount of 2% or more. Preferably, the retained austenite phase has an area proportion of 3% or more. In this regard, the strain-induced transformation of the retained austenite phase indicates that a strained portion of the retained austenite phase is transformed into a martensite phase when the material is deformed. However, the retained austenite phase has a high C concentration and is hard. Thus, if the retained austenite phase is present in the steel sheet in an excessive amount more than 10%, many locally hard portions are present. Such excessive amount of the retained austenite phase present is a factor that inhibits elongation and the uniform deformation of the material (steel sheet) at the time of stretch flanging, thereby causing difficulty in ensuring good elongation and stretch flangeability. In particular, a lower amount of the retained austenite is preferred from the viewpoint of stretch flangeability. Thus, the retained austenite phase has an area proportion of 10% or less and preferably 8% or less. Consequently, the retained austenite phase has an area proportion of 2% to 10%.

Conditions of a method for producing a high-strength cold-rolled steel sheet according to embodiments and a reason for the disclosed ranges will be described below.

In embodiments, a steel slab having the foregoing chemical composition is prepared. The steel slab is hot-rolled to form a steel sheet and is subjected to pickling. The steel sheet that has been subjected to pickling is subjected to a first heat treatment at a heat treatment temperature of 350° C. to 550° C. and then is subjected to cold rolling. The cold-rolled steel sheet is subjected to a second heat treatment at a heat treatment temperature of 800° C. to 900° C., a cooling rate of 10 to 80° C./s, a cooling stop temperature of 300° C. to 500° C., and a holding time of 100 to 1000 seconds at 300° C. to 500° C., and then subjected to a third heat treatment at a heat treatment temperature of 150° C. to 250° C.

In embodiments, the production of the steel slab is not particularly limited and may be performed in the usual manner. For example, a molten steel adjusted within the foregoing chemical composition range may be refined and cast to form a steel slab. As the steel slab in embodiments, a continuous cast slab, an ingot-making bloom slab, a thin slab having a thickness of about 50 mm to about 100 mm, or the like may be used. To particularly reduce segregation, a slab produced by a continuous casting process is preferably used.

The steel slab that has been produced and prepared as described above is hot-rolled to form a steel sheet. The hot rolling is not particularly limited and may be performed in the usual manner. The heating temperature of the steel slab at the hot rolling is preferably 1100° C. or higher. The upper limit of the heating temperature of the steel slab at the hot rolling is preferably about 1300° C. from the viewpoints of reducing scale formation and a fuel consumption rate. The finishing temperature (finish delivery temperature) of the hot rolling is preferably 850° C. or higher in order to avoid the formation of the band structure of ferrite and pearlite. The upper limit of the finishing temperature of the hot rolling is preferably about 950° C. from the viewpoints of reducing the scale formation and achieving a uniform, fine microstructure by inhibiting an increase in grain size. The coiling temperature after the completion of the hot rolling is preferably 400° C. to 600° C. from the viewpoints of cold rollability and surface properties.

The steel sheet after the coiling is subjected to pickling in the usual manner. Conditions of the pickling are not particularly limited and may be performed according to a known method, such as pickling with hydrochloric acid.

The steel sheet after the pickling is subjected to the first heat treatment (heat treatment for the first time), the cold rolling process, the second heat treatment (heat treatment for the second time), and the third heat treatment (heat treatment for the third time).

Heat Treatment Temperature of First Heat Treatment: 350° C. To 550° C.

To eliminate the influence of the microstructure of the steel sheet after the hot rolling, the hot-rolled steel sheet after the hot rolling is subjected to the first heat treatment. If the heat treatment temperature is lower than 350° C., tempering after the hot rolling is insufficient, thus failing to eliminate the influence of the microstructure after the hot rolling on the ultimately produced high-strength cold-rolled steel sheet. In other words, if the heat treatment temperature of the first heat treatment is lower than 350° C., when the hot-rolled steel sheet before the heat treatment has an unfavorable microstructure as described below, the steel sheet after the first heat treatment has a nonuniform microstructure due to the microstructure. As a result, in the microstructure of the steel sheet ultimately produced by subjecting the steel sheet after the first heat treatment to the cold rolling, the second heat treatment, and the third heat treatment, fine crystal grains are not formed, and sufficient stretch flangeability is not provided. The unfavorable microstructure described above indicates a nonuniform, single-phase bainite microstructure comprising a mixture of coarse crystal grains and fine crystal grains, a single-phase martensite microstructure, or a lamellar microstructure including ferrite and pearlite. Further, if the heat treatment temperature of the first heat treatment is lower than 350° C., the hot-rolled steel sheet is hardened to increase a load in the cold rolling, thus leading to an increase in cost. Meanwhile, if the heat treatment is performed at a temperature higher than 550° C., the resulting steel sheet has a microstructure with a nonuniform C concentration. Therefore coarse austenite is unevenly, coarsely distributed during the second heat treatment, thereby failing to form a uniform, fine microstructure. Here, the microstructure with a nonuniform C concentration indicates a microstructure in which coarse cementite with a high C concentration is coarsely distributed in the ferrite phase with a low C concentration. Moreover, if the heat treatment is performed at a temperature higher than 550° C., P segregates to grain boundaries to embrittle the steel sheet, thereby significantly reducing the elongation and the stretch flangeability.

The heat treatment (first heat treatment) in the range of 350° C. to 550° C. allows tempering to proceed. By allowing the tempering to proceed, distribution of cementite becomes present uniformly, finely, and densely in the steel sheet without coarsening. As a result, the ultimately formed microstructure after the cold rolling, the second heat treatment, and the third heat treatment includes fine crystal grains, thereby providing good stretch flangeability and bendability. Thus, in order to form a very fine microstructure before the cold rolling, the temperature of the first heat treatment that is performed after the hot rolling and before the cold rolling is in the range of 350° C. to 550° C. and preferably 400° C. to 540° C.

When the steel sheet after the hot rolling is subjected to the first heat treatment, the steel sheet is preferably held for about 5 minutes to about 5 hours at a heat treatment temperature of 350° C. to 550° C. If the holding time is less than 5 minutes, the influence of the microstructure after the hot rolling cannot be eliminated because of insufficient tempering after the hot rolling, in some cases. An excessively long holding time inhibits the productivity. Thus, the upper limit of the holding time is preferably about 5 hours. Hence, in the first heat treatment, the holding time at a holding temperature of 350° C. to 550° C. is preferably about 5 minutes to 5 hours. More preferably, the holding time at a holding temperature of 350° C. to 550° C. is 10 minutes to 4 hours.

The hot-rolled steel sheet that has been subjected to the first heat treatment is subjected to the cold rolling. There is no particular need for the limitation of a method of the cold rolling. The cold rolling may be performed in the usual manner. The rolling reduction ratio of the cold rolling is preferably about 30% to 70% from the viewpoint of forming a uniform recrystallized microstructure after the second heat treatment to stably ensure the material of the steel sheet.

To adjust the area proportion and the grain size of the steel microstructure to desired ranges, the steel sheet after the cold rolling is subjected to the second heat treatment at a heat treatment temperature of 800° C. to 900° C., a cooling rate of 10 to 80° C./s, a cooling stop temperature of 300° C. to 500° C., and a holding time of 100 to 1000 seconds at 300° C. to 500° C.

Heat Treatment Temperature of Second Heat Treatment: 800° C. to 900° C.

If the heat treatment temperature of the second heat treatment is lower than 800° C., the volume fraction of the ferrite phase is increased during heating and heat treatment. Thus, the area proportion of the ferrite phase in the microstructure of the ultimately produced steel sheet after the third heat treatment is increased, causing difficulty in ensuring a tensile strength (TS) of 1180 MPa or more. If the heat treatment temperature of the second heat treatment is lower than 800° C., an increase in C content in austenite is also promoted during the heat treatment. This excessively hardens the martensite phase before being subjected to tempering by the third heat treatment. The martensite phase is not sufficiently softened even after the third heat treatment, resulting in a reduction in the stretch flangeability of the steel sheet. If heating is performed to the high-temperature region of single-phase austenite, which is a temperature higher than 900° C., austenite grains are excessively coarsened. This coarsens the phases formed from austenite phase; ferrite phase and/or low-temperature transformation phase, thereby reducing the stretch flangeability of the steel sheet. Thus, the heat treatment temperature of the second heat treatment is in the range of 800° C. to 900° C. More preferably, the heat treatment temperature of the second heat treatment is in the range of 810° C. to 860° C.

Cooling Rate: 10 to 80° C./s

In the second heat treatment, cooling is performed after the heat treatment at the foregoing temperature. The cooling rate in the cooling is important in order to achieve a desired area proportion of the martensite phase. If the average cooling rate is less than 10° C./s, it is difficult to ensure the martensite phase, so that the ultimately produced steel sheet is softened to cause difficulty in ensuring strength. If the average cooling rate is more than 80° C./s, the martensite phase is excessively formed, so that the strength of the ultimately produced steel sheet is excessively increased, reducing the workability, such as the elongation and the stretch flangeability. Thus, the cooling rate is in the range of 10 to 80° C./s. More preferably, the average cooling rate is 15 to 60° C./s. The cooling is preferably performed by gas cooling. The cooling may be performed by, for example, furnace cooling, mist cooling, roll cooling, water cooling. The cooling may be a combination thereof.

Cooling Stop Temperature: 300° C. To 500° C.

If the cooling stop temperature at which the cooling is stopped is lower than 300° C., the martensite phase is excessively formed, so that the strength of the ultimately produced steel sheet is excessively increased, causing difficulty in ensuring the elongation. If the cooling stop temperature is higher than 500° C., the formation of the retained austenite is inhibited, causing difficulty in providing good elongation. To control the proportions of the tempered martensite phase and the retained austenite phase to desired ranges, thus, the cooling stop temperature in the second heat treatment is 300° C. to 500° C. That is, in order to ensure a tensile strength (TS) of about 1180 MPa or more as well as a good balance with elongation and stretch flangeability, the cooling stop temperature in the second heat treatment is 300° C. to 500° C. Preferably, the cooling stop temperature in the second heat treatment is 350° C. to 450° C.

Holding Time at 300° C. To 500° C.: 100 to 1000 Seconds

After the termination of the cooling at the foregoing temperature, holding is performed. If the holding time is less than 100 seconds, the time required for the increase in C content in the austenite phase is insufficient, thereby causing difficulty in ultimately achieving a desired area proportion of the retained austenite. Moreover, the martensite phase is excessively formed. Thus, the ultimately produced steel sheet is strengthened, thereby reducing the elongation and stretch flangeability of the steel sheet. Meanwhile, if the holding time is more than 1000 seconds, the retained austenite content is not increased, and the elongation is not significantly improved. A holding time more than 1000 seconds merely reduces the productivity. Thus, the holding time at 300° C. to 500° C. is in the range of 100 to 1000 seconds. Preferably, the holding time at 300° C. to 500° C. is in the range of 150 to 900 seconds.

After the second heat treatment, the third heat treatment is performed in order to temper the martensite phase.

Heat Treatment Temperature in Third Heat Treatment: 150° C. To 250° C.

If the heat treatment temperature in the third heat treatment is lower than 150° C., the softening of the martensite phase by the tempering is insufficient, thereby excessively hardening the martensite phase and reducing the stretch flangeability and bendability of the steel sheet. Meanwhile, if the heat treatment temperature is higher than 250° C., the retained austenite phase formed, after the second heat treatment is decomposed. Ultimately, the retained austenite phase having a desired area proportion is not formed, causing difficulty in producing a steel sheet having good elongation. Moreover, the martensite phase is decomposed into the ferrite phase and cementite, thereby causing difficulty in ensuring the strength. Thus, the heat treatment temperature is in the range of 150° C. to 250° C. and preferably 175° C. to 235° C.

When the third heat treatment is performed, the steel sheet is preferably held for about 5 minutes to about 5 hours at a holding temperature of 150° C. to 250° C. If the holding time in the third heat treatment is less than 5 minutes, the softening of the martensite phase is insufficient in some cases. In such cases, the martensite phase is excessively hardened, thereby failing to achieve sufficient stretch flangeability and bendability. The third heat treatment also affects the decomposition of the retained austenite and the temper softening of the martensite phase. Thus, an excessively long holding time can cause reductions in elongation and strength. When the holding time is up to about 5 hours, the material properties do not so change. An excessively long holding time reduces the productivity. Therefore the upper limit of the holding time is preferably about 5 hours. Thus, the holding time at a holding temperature of 150° C. to 250° C. in the third heat treatment is preferably about 5 minutes to about 5 hours. More preferably, the holding time at a holding temperature of 150° C. to 250° C. is about 10 minutes to about 4 hours.

The cold-rolled steel sheet produced as described above may be subjected to temper rolling (also referred to as "skin pass rolling") in the usual manner for shape correction and the adjustment of surface roughness. Here, elongation percentage in the temper rolling is not particularly regulated. The elongation percentage in the temper rolling is preferably, for example, about 0.05% to about 0.5%.

Example 1

Steels having chemical compositions described in Table 1 were refined to prepare steel slabs. Each of the steel slabs was subjected to hot rolling in which rolling was performed at a heating temperature of 1200° C. and a finish delivery temperature of 910° C. and in which after the completion of the rolling, the hot rolled steel sheet was cooled to a coiling temperature at 40° C./s and coiled at a coiling temperature of 450° C. The hot-rolled steel sheet obtained by the hot rolling was subjected to pickling with hydrochloric acid and then subjected to a first heat treatment under conditions described in Table 2. The hot-rolled steel sheet that had been subjected to the first heat treatment was subjected to cold rolling at a rolling reduction ratio of 30% to 70% so as to have a thickness of 1.6 mm and then subjected to a second heat treatment (annealing treatment) under conditions described in Table 2. The steel sheet that had been subjected to the second heat treatment was subjected to a third heat treatment under conditions described in Table 2, thereby producing a cold-rolled steel sheet.

TABLE 1

| | Chemical composition (% by mass) | | | | | | | | | | |
|---|---|---|---|---|---|---|---|---|---|---|---|
| Steel | C | Si | Mn | P | S | Al | N | Ti | B | Ca | Remarks |
| A | 0.155 | 1.55 | 2.51 | 0.007 | 0.0009 | 0.052 | 0.0045 | 0.005 | 0.0004 | 0.0003 | Example |
| B | 0.175 | 1.41 | 2.35 | 0.005 | 0.0008 | 0.043 | 0.0028 | 0.011 | 0.0009 | 0.0002 | Example |

TABLE 1-continued

| Steel | Chemical composition (% by mass) C | Si | Mn | P | S | Al | N | Ti | B | Ca | Remarks |
|---|---|---|---|---|---|---|---|---|---|---|---|
| C | 0.201 | 1.65 | 2.15 | 0.008 | 0.0007 | 0.039 | 0.0041 | 0.022 | 0.0003 | 0.0001 | Example |
| D | 0.209 | 1.35 | 2.31 | 0.006 | 0.0009 | 0.042 | 0.0036 | 0.031 | 0.0008 | 0.0002 | Example |
| E | 0.194 | 1.47 | 2.56 | 0.004 | 0.0008 | 0.045 | 0.0025 | 0.017 | 0.0006 | 0.0004 | Example |
| F | 0.252 | 1.28 | 2.65 | 0.014 | 0.0006 | 0.037 | 0.0032 | 0.012 | 0.0009 | 0.0002 | Comparative Example |

TABLE 2

| No. | Steel | First heat treatment: Heat treatment temperature (° C.) | First heat treatment: Holding time | Second heat treatment: Heat treatment temperature (° C.) | Second heat treatment: Cooling rate (° C./s) | Second heat treatment: Cooling stop temperature (° C.) | Second heat treatment: Holding time (s) | Third heat treatment: Heat treatment temperature | Third heat treatment: Holding time | Remarks |
|---|---|---|---|---|---|---|---|---|---|---|
| 1 | A | 500 | 4 hours | 845 | 20 | 420 | 900 | 175 | 10 minutes | Example |
| 2 | B | 540 | 10 minutes | 855 | 30 | 400 | 600 | 200 | 4 hours | Example |
| 3 | C | 480 | 1 hour | 835 | 55 | 410 | 360 | 225 | 30 minutes | Example |
| 4 | D | 440 | 30 minutes | 815 | 35 | 370 | 180 | 235 | 20 minutes | Example |
| 5 | E | 520 | 4 hours | 825 | 15 | 390 | 150 | 220 | 1 hour | Example |
| 6 | F | 470 | 2 hours | 835 | 35 | 430 | 540 | 200 | 1 hour | Comparative Example |
| 7 | A | 250 | 10 minutes | 845 | 55 | 460 | 300 | 180 | 1 hour | Comparative Example |
| 8 | A | 750 | 10 minutes | 855 | 65 | 450 | 240 | 190 | 1 hour | Comparative Example |
| 9 | B | 400 | 10 minutes | 750 | 45 | 410 | 180 | 210 | 1 hour | Comparative Example |
| 10 | B | 440 | 1 hour | 950 | 25 | 390 | 120 | 230 | 1 hour | Comparative Example |
| 11 | C | 480 | 1 hour | 855 | 2 | 370 | 420 | 220 | 10 minutes | Comparative Example |
| 12 | C | 520 | 4 hours | 835 | 100 | 410 | 480 | 200 | 10 minutes | Comparative Example |
| 13 | D | 540 | 4 hours | 815 | 15 | 250 | 540 | 180 | 10 minutes | Comparative Example |
| 14 | D | 510 | 4 hours | 825 | 45 | 550 | 360 | 140 | 10 minutes | Comparative Example |
| 15 | E | 470 | 4 hours | 845 | 75 | 400 | 30 | 240 | 10 minutes | Comparative Example |
| 16 | E | 430 | 20 minutes | 865 | 25 | 390 | 150 | 50 | 4 hours | Comparative Example |
| 17 | E | 390 | 20 minutes | 855 | 35 | 420 | 240 | 300 | 4 hours | Comparative Example |

Regarding the resulting cold-rolled steel sheets, the microstructure, the tensile characteristics, the stretch flangeability (hole expansion ratio), and the bending characteristics of the steel sheets were studied as described below. Table 3 describes the results.

(1) Microstructure of Steel Sheet

The total area proportion of the ferrite phase and the bainite phase with respect to the entire microstructure was determined by the observation of a region on a cross section in the rolling direction with an optical microscope, the region being located at a position away from a surface of the steel sheet by ¼ of the sheet thickness. Specifically, the area of each phase in a randomly-selected 100 μm×100 μm square region was determined by image analysis with a photograph of a cross sectional microstructure at a magnification of 1000×. The observation was performed at N=5 (5 fields of observation).

Here, etching was performed with a liquid mixture of 3% by volume of picral and 3% by volume of sodium metabisulfite. Black regions observed after the etching were defined as the ferrite phase (polygonal ferrite phase) or the bainite phase. The area proportion of the black regions was determined as the total area proportion of the ferrite phase and the bainite phase.

The area proportion of the tempered martensite phase with respect to the entire microstructure was determined by the observation of a region on a cross section in the rolling direction with a scanning electron microscope (SEM), the region being located at a position away from a surface of the steel sheet by ¼ of the sheet thickness. Specifically, the area of each phase in a randomly-selected 50 μm×50 μm square region was determined by image analysis with a photograph of a cross sectional microstructure at a magnification of 2000×. The observation was performed at N=5 (5 fields of observation). The area proportion of the tempered martensite phase was determined by SEM observation before and after tempering as described below. Specifically, a microstructure which is observed to have a blocky shape and a relatively smooth surface before tempering and which is observed to include fine carbide precipitates inside after tempering is recognized as tempered martensite phase. Then, the area proportion of the tempered martensite phase was determined.

Regarding the area proportion of the retained austenite phase, the retained austenite content was separately measured by the X-ray diffraction method, and the measured retained austenite content was defined as the area proportion. The retained austenite content was determined by the X-ray diffraction method with MoKα radiation. Specifically, a test piece having a measuring a region located at a position away from a surface of the steel sheet by ¼ of the sheet thickness was used. The volume fraction of the retained austenite phase was calculated from the peak intensities of the (211) and (220) planes of the austenite phase and the (200) and (220) planes of the ferrite phase. The calculated volume fraction of the retained austenite phase was defined as the retained austenite content and as the area proportion of the retained austenite phase.

The average grain size of the ferrite phase and the bainite phase was determined by counting the number of grains in the measurement regions (the number of grains in the black regions), calculating the average grain area a with the area proportion of the phases in the measurement area, and using a planimetric method in which the grain size $d=a^{1/2}$. The average grain size of the tempered martensite phase was determined by counting the number of grains in the measurement regions, calculating the average grain area a with the area proportion of the phase in the measurement area, and using a planimetric method in which the grain size $d=a^{1/2}$.

(2) Tensile Characteristics (Strength and Elongation)

The tensile characteristics were evaluated by performing a tensile test in compliance with JIS 22241 using No. 5 test pieces according to JIS 22201, a longitudinal direction (tensile direction) of each of the test pieces being defined as a direction (direction at right angle to the rolling direction) extending at an angle of 90° to the rolling direction. Table 3 describes the yield strength (YP), the tensile strength (TS), and the total elongation (El). The evaluation criteria of the tensile characteristics were described below: in the case where TS≥1180 MPa and where TS×El≥21,000 MPa·%, the tensile characteristics were rated as satisfactory, and the strength and the elongation were excellent.

(3) Hole Expansion Ratio (Stretch Flangeability)

To evaluate the stretch flangeability, the hole expansion ratio was measured according to Japan Iron and Steel Federation Standard JFST 1001. The measurement of the hole expansion ratio was performed as described below. Specifically, a hole having an initial diameter $d_0$ of 10 mm was formed by punching. A conical punch with an angle of 60° was raised to expand the hole. At this time, when a crack (on punched face) passed through the thickness of the steel sheet, the raising of the punch was stopped, and the diameter d of the hole after the crack had passed therethrough was measured. Next, the hole expansion ratio was calculated from hole expansion ratio $(\%)=((d-d_0)/d_0)\times 100$. The test was performed three times for each steel sheet having the same number, and the average value (λ) of the hole expansion ratios was determined. The evaluation criteria of the stretch flangeability were described below: in the case where TS×λ≥38,000 MPa·% (TS: tensile strength (MPa), λ: hole expansion ratio (%)), the stretch flangeability was rated as excellent.

(4) Bending Characteristics

A bending test piece was taken from the resulting steel sheet having a thickness t of 1.6 mm in such a manner that the ridge line of a bending portion was parallel to the rolling direction. The bending test piece had a size of 40 mm×100 mm. The long side of the bending test piece extended to the direction at right angle to the rolling direction. Thus prepared bending test piece was subjected to 90° V-bending using a metal die having a tip with a bending radius R of 2.5 mm at a pressing load of 29.4 kN at the bottom dead center. The presence or absence of a crack at the top of the bend was visually determined. When no crack was formed, the bendability was rated as satisfactory.

TABLE 3

| | | Steel microstructure | | | | | |
|---|---|---|---|---|---|---|---|
| No. | Steel | Total area proportion of ferrite phase and bainite phase (%) | Average grain size of ferrite phase and bainite phase (μm) | Area proportion of tempered martensite phase (%) | Average grain size of tempered martensite phase (μm) | Area proportion of retained austenite phase (%) | d(α + B)/d (TM)* |
| 1 | A | 64 | 1.9 | 32 | 2.3 | 4 | 0.8 |
| 2 | B | 53 | 2.2 | 44 | 2.5 | 3 | 0.9 |
| 3 | C | 64 | 1.8 | 31 | 1.9 | 5 | 0.9 |
| 4 | D | 68 | 1.4 | 29 | 1.2 | 3 | 1.2 |
| 5 | E | 66 | 1.5 | 28 | 1.7 | 6 | 0.9 |
| 6 | F | 65 | 1.8 | 31 | 2.1 | 4 | 0.9 |
| 7 | A | 59 | 2.7 | 35 | 3.6 | 6 | 0.8 |
| 8 | A | 61 | 2.8 | 36 | 4.0 | 3 | 0.7 |
| 9 | B | 76 | 1.1 | 16 | 1.2 | 8 | 0.9 |
| 10 | B | 12 | 3.8 | 86 | 6.2 | 2 | 0.6 |
| 11 | C | 78 | 2.3 | 20 | 2.5 | 2 | 0.9 |
| 12 | C | 7 | 1.7 | 86 | 2.1 | 7 | 0.8 |
| 13 | D | 53 | 1.5 | 46 | 1.3 | 1 | 1.2 |
| 14 | D | 63 | 1.6 | 36 | 1.9 | 1 | 0.8 |
| 15 | E | 56 | 1.8 | 43 | 1.6 | 1 | 1.1 |
| 16 | E | 52 | 2.4 | 43** | 2.7** | 5 | — |
| 17 | E | 56 | 2.2 | 43 | 2.0 | 1 | 1.1 |

| | Material characteristics | | | | | | |
|---|---|---|---|---|---|---|---|
| No. | YP (MPa) | TS (MPa) | El (%) | λ (%) | Presence or absence of crack at top of bend | TS × EL (MPa-%) | TS × λ (MPa-%) | Remarks |
| 1 | 870 | 1180 | 17.8 | 33 | absent | 21004 | 38940 | Example |
| 2 | 855 | 1240 | 17.3 | 31 | absent | 21452 | 38440 | Example |

TABLE 3-continued

| | | | | | | | | |
|---|---|---|---|---|---|---|---|---|
| 3 | 880 | 1200 | 17.5 | 32 | absent | 21000 | 38400 | Example |
| 4 | 900 | 1195 | 17.6 | 32 | absent | 21032 | 38240 | Example |
| 5 | 875 | 1190 | 17.8 | 32 | absent | 21182 | 38080 | Example |
| 6 | 1050 | 1350 | 12.5 | 22 | present | 16875 | 29700 | Comparative Example |
| 7 | 880 | 1210 | 13.5 | 20 | present | 16335 | 24200 | Comparative Example |
| 8 | 900 | 1220 | 13.2 | 21 | present | 16104 | 25620 | Comparative Example |
| 9 | 860 | 1100 | 18.1 | 45 | absent | 19910 | 49500 | Comparative Example |
| 10 | 1220 | 1450 | 10.6 | 22 | present | 15370 | 31900 | Comparative Example |
| 11 | 820 | 1080 | 18.5 | 40 | absent | 19980 | 43200 | Comparative Example |
| 12 | 1150 | 1290 | 13.3 | 23 | present | 17157 | 29670 | Comparative Example |
| 13 | 1120 | 1270 | 12.8 | 26 | present | 16256 | 33020 | Comparative Example |
| 14 | 1000 | 1280 | 12.4 | 42 | present | 15872 | 53760 | Comparative Example |
| 15 | 840 | 1320 | 11.7 | 26 | present | 15444 | 34320 | Comparative Example |
| 16 | 650 | 1380 | 13.1 | 10 | present | 18078 | 13800 | Comparative Example |
| 17 | 1030 | 1150 | 17.1 | 42 | absent | 19665 | 48300 | Comparative Example |

*d(α + B): average grain size (μm) of ferrite phase + bainite phase, d(TM): average grain size (μm) of tempered martensite phase
**The area proportion and the average grain size of martensite not transformed into tempered martensite.

Table 3 reveals that in the examples, both TS×El≥21,000 MPa·% and TS×2≥38,000 MPa·% are achieved and that the 90° V-bending is satisfied at R/t=2.5/1.6=1.6 without cracking. Table 3 reveals that in the examples, the high-strength cold-rolled steel sheets having excellent elongation, stretch flangeability, and bendability and having a tensile strength of 1180 MPa or more are produced.

In contrast, No. 6, in which the steel chemical composition is outside the range of disclosed embodiments, is poor in elongation, stretch flangeability, and bendability. In No. 7, in which the heat treatment temperature in the first heat treatment after the hot rolling is low, and No. 8, in which the heat treatment temperature in the first heat treatment is high, the tempered martensite phases have large grain sizes, and the elongation, the stretch flangeability, and the bendability were poor. In No. 9, in which the heat treatment temperature in the second heat treatment is low, and No. 11, in which the cooling rate in the second heat treatment is low, the total area proportions of the ferrite phases and the bainite phases are high, and TS 1180 MPa is not satisfied. In No. 10, in which the heat treatment temperature in the second heat treatment is high, the total area proportion of the ferrite phase and the bainite phase is low, the grain size is large, and the strength is excessively high; hence, the elongation, the stretch flangeability, and the bendability are poor. In No. 12, in which the cooling rate in the second heat treatment is high, the total area proportion of the ferrite phase and the bainite phase is low, and the strength is excessively high; hence, the elongation, the stretch flangeability, and the bendability are poor. In No. 13, in which the cooling stop temperature in the second heat treatment is low, No. 14, in which the cooling stop temperature is high, No. 15, in which the holding time is short, and No. 17, in which the heat treatment temperature in the third heat treatment is high, the area proportions of the retained austenite phases are low, and the elongation is low. In No. 16, in which the heat treatment temperature in the third heat treatment is low, the tempering of the martensite phase is insufficient, so that the tempered martensite phase is not obtained, and the strength is excessively high; hence, the elongation, the stretch flangeability, and the bendability are poor.

INDUSTRIAL APPLICABILITY

According to embodiments, it is possible to provide an inexpensive, high-strength cold-rolled steel sheet having excellent elongation and stretch flangeability and having a tensile strength (TS) of 1180 MPa or more without actively adding an expensive element, for example, Nb, V, Cu, Ni, Cr, or Mo, to the steel sheet. Moreover, the high-strength cold-rolled steel sheet according to embodiments is also suitable for applications that require strict dimensional accuracy and workability, such as fields of architecture and household electrical appliances, in addition to automotive components.

The invention claimed is:

1. A cold-rolled steel sheet having a steel composition comprising:

0.12% to 0.22% C, by mass %;
0.8% to 1.8% Si, by mass %;
1.8% to 2.8% Mn, by mass %;
0.020% or less P, by mass %;
0.0040% or less S, by mass %;
0.005% to 0.08% Al, by mass %;
0.008% or less N, by mass %;
0.001% to 0.040% Ti, by mass %;
0.0001% to 0.0020% B, by mass %;
0.0001% to 0.0020% Ca, by mass %; and
Fe and incidental impurities, wherein the cold-rolled steel sheet includes a microstructure in which:

a ferrite phase and a bainite phase are present in an amount in the range of 50% to 70% of the total area of the microstructure, the average grain size of the ferrite phase and the bainite phase is in the range of 1 to 3 μm, a tempered martensite phase is present in an amount in the range of 25% to 45% of the total area of the microstructure, the average grain size of the tempered martensite phase is in the range of 1.2 to 3 μm, and a retained austenite phase is present in an amount in the range of 2% to 10% of the total area of the microstructure.

2. The cold-rolled steel sheet according to claim 1, wherein a ratio of the average grain size of the ferrite phase and the bainite phase to the average grain size of the tempered martensite phase is in the range of 0.5 to 3.0.

3. The cold-rolled steel sheet according to claim 1, wherein the steel sheet has a tensile strength in the range of 1180 MPa or more.

4. The cold-rolled steel sheet according to claim 3, wherein the steel sheet satisfies TS×El≥21,000 MPa·%, where TS: tensile strength (MPa) and EL: total elongation (%).

5. The cold-rolled steel sheet according to claim 3, wherein the steel sheet satisfies TS×λ≥38,000 MPa·%, where TS: tensile strength (MPa) and λ: hole expansion ratio (%).

6. The cold-rolled steel sheet according to claim 1, wherein the average grain size of the tempered martensite is in the range of 1.2 to 2.5 μm.

7. A method for producing the cold-rolled steel sheet of claim 1, the method comprising:

preparing a steel slab;

hot-rolling the steel slab into a steel sheet;

performing pickling on the steel sheet;

subjecting the steel sheet after the pickling to a first heat treatment at a heat treatment temperature in the range of 350° C. to 550° C.;

then performing cold rolling;

subjecting the steel sheet after the cold rolling to a second heat treatment at a heat treatment temperature in the range of 800° C. to 900° C., a cooling rate in the range of 10 to 80° C./s, a cooling stop temperature in the range of 300° C. to 500° C., and a holding time in the range of 100 to 1000 seconds at a temperature in the range of 300° C. to 500° C.; and then performing a third heat treatment at a heat treatment temperature in the range of 150° C. to 250° C.

8. The method for producing a cold-rolled steel sheet according to claim 7, wherein the step of hot rolling includes heating the steel slab at a temperature in the range of 1100° C. to 1300° C., and finishing the hot rolling at a temperature in the range of 850° C. to 950° C.

9. The method for producing a cold-rolled steel sheet according to claim 8, wherein the first heat treatment is performed for a holding time in the range of 5 minutes to 5 hours at a temperature in the range of 350° C. to 550° C.

10. The method for producing a cold-rolled steel sheet according to claim 9, wherein the third heat treatment is performed for a holding time in the range of 5 minutes to 5 hours at a temperature in the range of 150° C. to 250° C.

11. The method for producing a cold-rolled steel sheet according to claim 8, wherein the third heat treatment is performed for a holding time in the range of 5 minutes to 5 hours at a temperature in the range of 150° C. to 250° C.

12. The method for producing a cold-rolled steel sheet according to claim 7, wherein the first heat treatment is performed for a holding time in the range of 5 minutes to 5 hours at a temperature in the range of 350° C. to 550° C.

13. The method for producing a cold-rolled steel sheet according to claim 12, wherein the third heat treatment is performed for a holding time in the range of 5 minutes to 5 hours at a temperature in the range of 150° C. to 250° C.

14. The method for producing a cold-rolled steel sheet according to claim 7, wherein the third heat treatment is performed for a holding time in the range of 5 minutes to 5 hours at a temperature in the range of 150° C. to 250° C.

* * * * *